US006220891B1

(12) United States Patent
Hils

(10) Patent No.: US 6,220,891 B1
(45) Date of Patent: Apr. 24, 2001

(54) PROBE CONNECTOR

(75) Inventor: Christopher Matthew Hils, Issaquah, WA (US)

(73) Assignee: Zetec, Inc., Issaquah, WA (US)

( * ) Notice: Subject to any disclaimer, the term of this patent is extended or adjusted under 35 U.S.C. 154(b) by 0 days.

(21) Appl. No.: 09/339,493

(22) Filed: Jun. 24, 1999

(51) Int. Cl.[7] ..... H01R 13/00
(52) U.S. Cl. ..... 439/482; 439/284
(58) Field of Search ..... 324/220; 439/482, 439/287, 700, 219, 291, 281, 284

(56) References Cited

U.S. PATENT DOCUMENTS 3,953,099 * 4/1976 Wilson ..... 439/556
4,179,179 * 12/1979 Lowden ..... 439/559
5,146,786 * 9/1992 Nachbar ..... 73/623

* cited by examiner

*Primary Examiner*—Renee Luebke
*Assistant Examiner*—Briggitte R. Hammond

(74) *Attorney, Agent, or Firm*—David L. Tingey

(57) ABSTRACT

A connector of electromagnetically insulative material includes a shaft section on a drive shaft end and a matching probe section on an eddy current probe mating to the shaft section with face to face contact surfaces to prevent electromagnetic fields from propagating along the surfaces. The connector includes upper and lower portions with power line connecting pins and matching sockets in the upper portions of the sections and communication line connecting pins and matching sockets in the lower portions of the sections. The pins and sockets are fitted within electrically nonconductive inserts within probe and shaft section bores, the inserts having magnetic permeabilities less than those of the probe and shaft sections. The section matching surfaces at the power line upper portion are spaced apart longitudinally from the section matching surfaces at the communication line lower sections by a planar ledge on each of the upper and lower sections which ledges rest in mutual face to face contact when the union is connected. A plug extends from a shaft section outside corner into a trepan at a probe section inside corner to further impede electromagnetic field leakage.

18 Claims, 3 Drawing Sheets

PROBE CONNECTOR

BACKGROUND

1. Field of the Invention

The present invention relates generally to remote nondestructive sensors and, more particularly, to a connector capable of disconnecting a probe from a probe drive shaft while insulating a data line from a drive line when the probe is connected to the shaft.

2. Prior Art

It is known in the art to have a remote sensor, or probe, traveling in small tubes as small as ½ inch inside diameter such as are found in steam generators and heat exchangers to inspect the integrity of such tubes or to deliver the probe to a remote location. Generally, a testing probe is urged through a tube by means of a positioning, or drive, shaft to which it is attached. During operation, the probe sensor is driven by a drive line voltage and transmits responsive measurement data, both through cables carried within the shaft. An Eddy current probe is one such remote sensor commonly employed in the inspection of tubes.

Cracks and bubbles and other material nonuniformities produce variations in conductivity and permeability. Induction of Eddy currents in the material is a commonly-used technique for nondestructively detecting such defects near the surface of materials by sensing changes in material conductivity or permeability at a material nonuniformity by detecting changes in Eddy currents. Eddy currents are induced in the test material by a drive coil in an Eddy current probe. An oscillating electrical current in the coil generates an alternating primary electromagnetic field that is propagated into the test material. It is this primary field that induces the Eddy currents in the measured material. The Eddy currents in turn generate a secondary electromagnetic field that is propagated back to a sense coil in the probe where an electric current and voltage is induced. The sense coil voltage is therefore a function of the magnitude of Eddy current flow in the test piece. Discontinuities and nonuniformities in the material being tested with inherent change in permeability and conductivity cause a reduction in the magnitude of the Eddy currents and thus a change in the voltage in the sense coil which is analyzed as an indicator of the causing defect in the test material.

The voltage to the drive coil, which might be 400 volts at 4–5 watts, is typically carried in a coaxial drive cable within the drive shaft to the eddy current probe coil. The voltage induced in the sense coil at perhaps 1% of the drive voltage is carried from the probe in a different data cable, well insulated and separated from the drive cable so the drive voltage does not induce a voltage in the data cable that overwhelms the data voltage. When multiple drive coils and multiple sense coils are employed in the probe, a plurality of drive cables are employed, all spaced apart and insulated from multiple data cables.

It is often desirable to disconnect the probe head from the shaft for probe replacement or repair. This requires that the power drive lines and data communication cables be broken. At the break, without other precautions, loss of insulation between the power and communication cables induces cross-talk into the data lines that masks the data signals. Available large coaxial connectors designed to prevent this cross-talk are not suitable because their size prevents their use in small, ½ inch tubes. Thus, previously detachment of an Eddy current probe from the shaft has been ill-advised.

SUMMARY

It is the primary object of the present invention to provide a cable connector useful to connect and disconnect an Eddy current probe from a drive shaft including power and communication cables passing through the shaft to the probe. A second object is to maintain electromagnetic insulation between the power and communication cables at the connector break to avoid electromagnetic leakage from the power cable that might induce a voltage in the communication cable. Another object is that the connector be sufficiently small so that it can be employed in tubes with an inside diameter of about ½ inch.

These objects are achieved in a connector comprising a union with connectable shaft and probe sections of electromagnetically insulative material mating at matching transverse surfaces. The connector includes upper and lower portions with power line connecting pins and matching sockets in the upper portions of the sections and communication line connecting pins and matching sockets in the lower portions of the sections. Each section upper portion transverse surface is separated, or staggered, longitudinally from its lower section transverse surface by a planar ledge surface. The two ledges and the section upper and lower matching surfaces are in face to contact when the union is connected. A trepan may also be provided at inner comers formed between ledge and transverse surfaces. Matching plugs at outer comers formed between ledge and transverse surfaces then slide into and fill the trepans when the connector is closed. Thus, any electromagnetic radiation that may leak from the connection of the matching surfaces at the power line upper portion is effectively prevented from conducting to the connection of the matching surfaces at the communication line lower portion.

DETAILED DESCRIPTION OF THE PREFERRED EMBODIMENT

Figure 1:
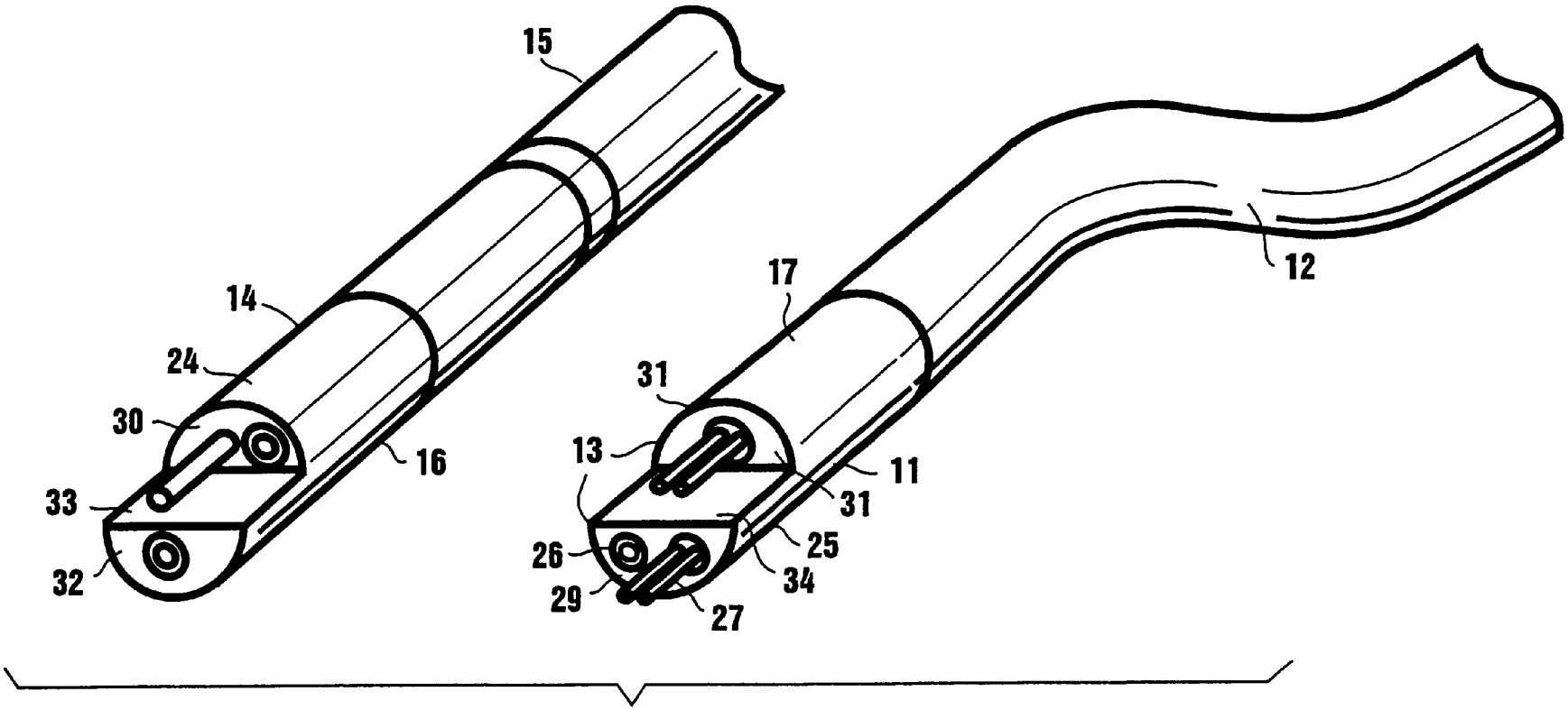
FIG. 1 is a perspective view of the shaft and probe sections of the connector, side by side.

The probe connector of the present invention comprises a cylindrical union 10 having a shaft section 11 intended to be connected to a drive shaft 12. The shaft section is disconnectable at a break 13 from a probe section 14 intended to be connected to a remote probe such as an eddy current probe 15.

Figure 2:
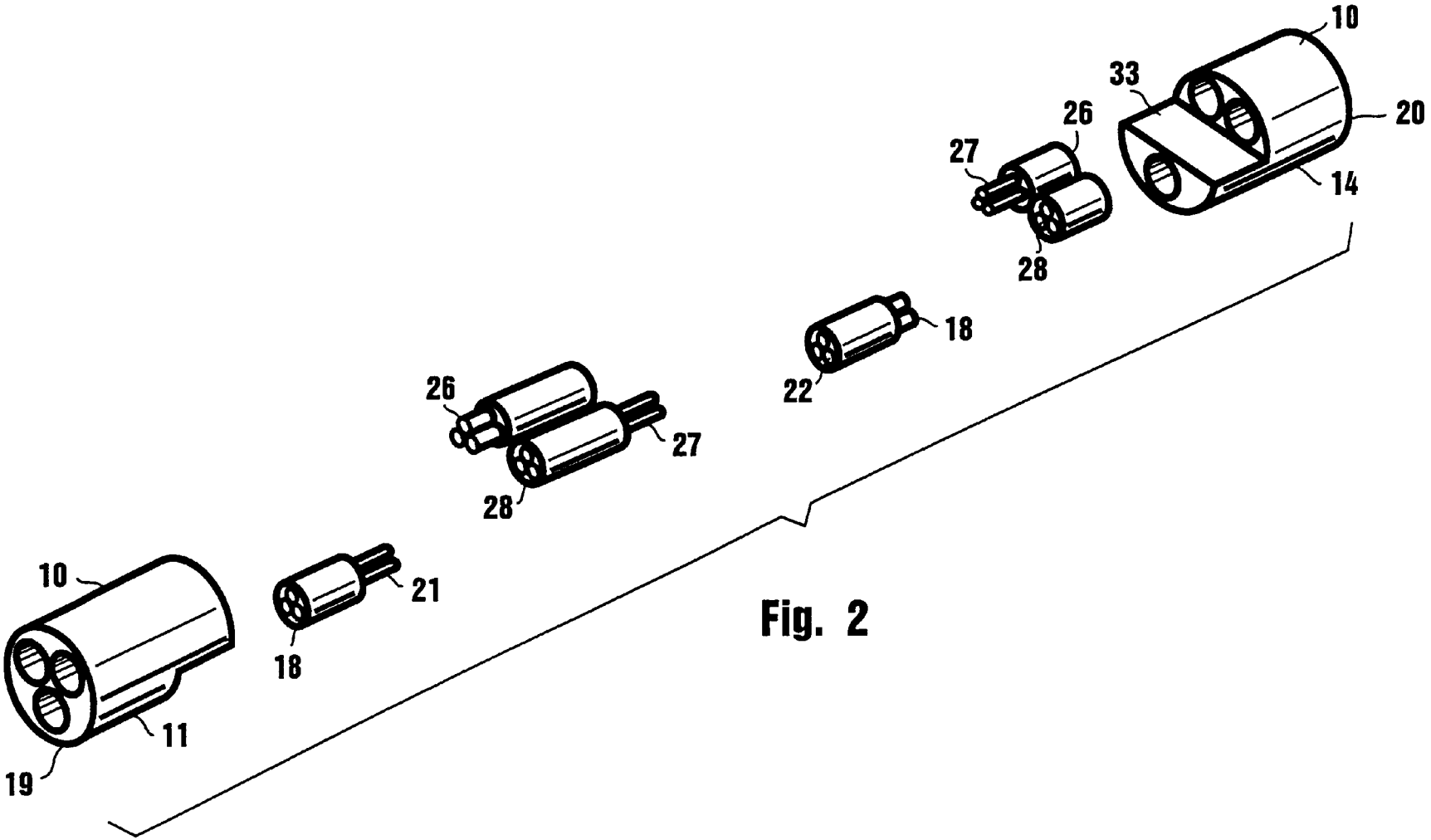
FIG. 2 is an exploded view of the connector of FIG. 1.

A union lower portion including a probe section lower portion 16 and a shaft section lower portion 17 houses a plurality of power lines 18 between union ends 19 and 20 for providing a drive voltage to a probe. The power lines are shown in FIG. 2 to comprise four power connector pins 21 in the shaft section 11 and four power connector sockets 22 matching and in alignment with the pins 21 for receiving the pins in electrical contact in the probe section.

An upper portion including a probe section upper portion 24 and a shaft section upper portion 25 similarly houses a plurality of data communication lines 26 between union ends 19 and 20 for communicating a data signal from at least one probe. The data communication lines are shown in FIG. 2 to comprise two sets of three data connector pins 27 in the probe section and two sets of three data connector sockets 28 or pins 27 (typically one set of sockets and one set of pins) matching and in alignment with the pins for receiving the pins in electrical contact. Clearly, it is equivalent to reverse the pin and socket locations with the pins in the pins in the shaft section and the sockets in the probe section. It is to be understood for both the power lines and the data communication lines that the number of connector pins and connector sockets are given as an example, and another number of pins and sockets is to be deemed included in the definition of the connector.

The shaft and probe sections include matching upper portion transverse contact surfaces 29 and 30 that come into face to face contact when the union is connected. Matching lower portion transverse contact surfaces 31 and 32 are similarly in face to face contact along with the upper surfaces when the union is closed. The contact surfaces of the upper portion are spaced apart, or staggered, from the contact surfaces of the lower portion. Necessarily, the shaft section upper portion extends substantially beyond the shaft section lower portion, and the probe section lower portion extends likewise beyond the probe section upper portion. A longitudinal planar ledge 33 runs between the staggered upper and lower contact surfaces. Thus, the upper portion of the shaft section overlaps the lower portion of the probe section on matching sliding planar ledges 33 and 34 also in face to face contact to form an integral union body with effectively no airspace between contacting ledges. With the union formed of an electromagnetically insulative material, there is effectively no electromagnetic leak between the power lines and the data communication lines due to the union break.

Figure 3:
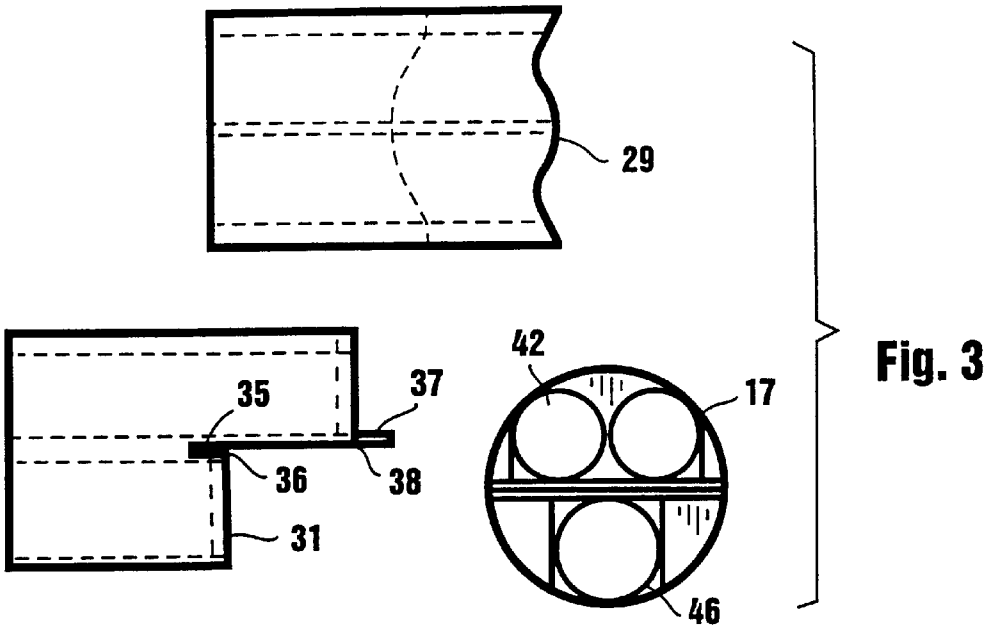
FIG. 3 shows top, end and side views of the shaft section showing insert bores
Figure 5:
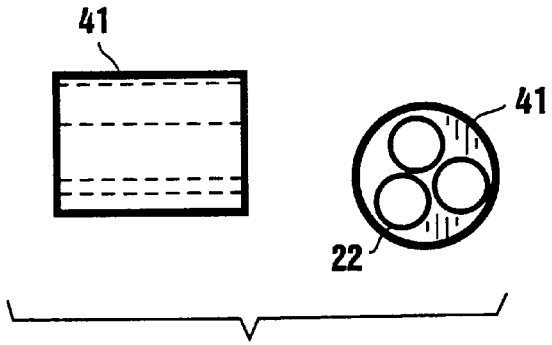
FIG. 5 shows end and side views of a three-pin probe insert.
Figure 6:
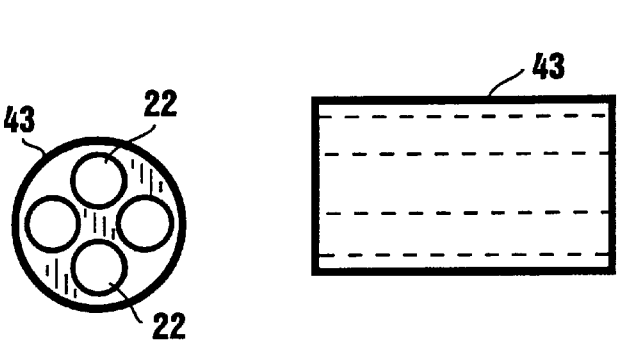
FIG. 6 shows end and side views of a four-pin shaft insert.
Figure 4:
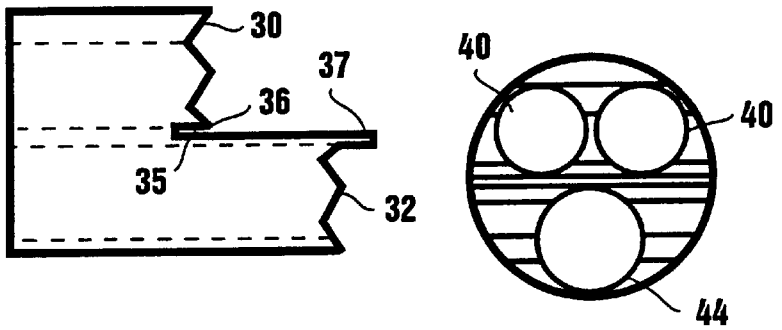
FIG. 4 shows end and side views of the probe section showing insert bores.

In a first embodiment the transverse contact surfaces 29, 30, 31, and 32 are planar. In an alternative embodiment, they are nonplanar so that propagation of an electromagnetic field along the surface is further impeded as shown in FIG. 3 and FIG. 4.

As a further impediment to electromagnetic field propagation from the power lines along the longitudinal planar ledge, a trepan 35 may be provided in the probe section at one or both inside comer intersections 36 of the transverse contact surface and the longitudinal planar ledge extending across the transverse contact surface. A plug 37 closely matching the trepan or trepans in size and shape extend from one or both outside comers 38, respectively, of the shaft section at the intersection of its transverse contact surface and its longitudinal planar ledge also extending across its transverse contact surface such that with the transverse surfaces in face to face contact, the plug or plugs fit closely within the trepan or trepans. Thus, for an electromagnet field to propagate from the power lines along the transverse surfaces and the longitudinal planar ledge, it must also propagate and change directions along each plug and trepan pair or jump the plug. Because a change of direction dampens an electromagnetic field as it is absorbed by the insulative material of the connector, and because the plug leaves virtually no open air space within the trepan in which the field may propagate, field propagation is effectively eliminated. Also, because the plug is a strongly insulative material, a field is effectively unable to propagate through it The probe section upper portion has longitudinal bores 40 therethrough in each of which is secured a probe section insert 41. Typically, one insert contains connector pins 27 and one insert contains connector sockets 28. Correspondingly, the shaft section upper portion has longitudinal bores 42 therethrough in each of which is secured a shaft section insert 43 containing the connector sockets 22. Similarly, the probe section lower portion has a longitudinal bore with inserts containing its connector sockets 22 and the shaft section lower portion has a longitudinal bore 46 with inserts containing its connector pins 27. Probe section insert 41 and shaft section insert 43 both are electrically nonconductive with permeabilities less than that of the probe section and shaft section such that propagation of electromagnetic waves through the inserts is impeded.

What is claimed is:

1. A probe connector for connecting to and disconnecting from a shaft, comprising, a union having a shaft section at a union shaft end and a probe section at a union probe end disconnectably joined together, the shaft section including an upper portion with a contact surface and a lower portion with a contact surface; and the probe section including an upper portion with a contact surface and a lower portion with a contact surface; the probe section surfaces matching the surfaces of the respective shaft section upper and lower portions, a first electric conductor within and extending through the lower portions between the union ends, a second electric conductor within and extending through the shaft section and probe section upper portions between the union ends, the shaft section upper portion extending substantially beyond the shaft section lower portion, and the probe section lower portion extending substantially beyond the probe section upper portion with the upper of the shaft section overlapping the lower portion of the probe section on matching longitudinal ledges to form an integral body, the probe section contact surfaces and longitudinal ledges in close face to face contact, with effectively no airspace therebetween therein forming an electromagnetic insulator between the electric conductor within the lower portions and the electric conductor within the upper portions, the first and second conductors establishing electrical contact when the sections are joined together.

2. The probe connector of claim 1 in which the union is of electromagnetically insulative material.

3. The probe connector of claim 1 in which the union is cylindrical.

4. The probe connector of claim 1 in which the longitudinal ledges are planar.

5. The probe connector of claim 1 in which the union shaft section lower portion has a bore longitudinally therethrough and the union probe section has a first bore longitudinally therethrough aligned with the shaft section bore, the connector further comprising, a shaft section lower portion insert in the shaft section lower portion bore with said second electrical conductor therein, a probe section lower portion insert in the probe section lower portion bore with said second electrical conductor therein.

6. The probe of claim 1 further comprising a first trepan in the shaft section at a first inside corner formed by an intersection of the shaft section transverse contact surface and the shaft section longitudinal planar ledge, a first electromagnetically insulative plug closely matching the first trepan in size and shape and extending from said shaft section outside corner such that with the transverse surfaces in face to face contact, the plug fits closely within the trepan.

7. The probe of claim 1 further comprising a first trepan in the shaft section at a first inside corner formed by an intersection of the shaft section transverse contact surface and the shaft section longitudinal planar ledge, a second trepan in the probe section at a second inside corner formed by an intersection of the probe section transverse contact surface and the shaft section longitudinal planar ledge, a first electromagnetically insulative plug closely matching the first trepan in size and shape and extending from said shaft section outside corner such that with the transverse surfaces in face to face contact, the plug fits closely within the trepan, and a second electromagnetically insulative plug closely matching the second trepan in size and shape and extending from said probe section outside corner such that with the transverse surfaces in face to face contact, the plug fits closely within the trepan.

8. The probe connector of claim 1 in which the union shaft section upper portion has a first bore longitudinally therethrough and the union probe section has a first bore longitudinally therethrough aligned with the shaft section first bore, the connector further comprising, a shaft section first insert in the shaft section bore with said first electrical conductor therein, a probe section first insert in the probe section bore with said second electrical conductor therein.

9. The probe connector of claim 5 in which said shaft section insert and said probe section insert are electrically nonconductive and have magnetic permeabilities less than that of the respective shaft section and probe section such that propagation of electromagnetic waves through the inserts is impeded.

10. The probe connector of claim 8 in which the union shaft section upper portion has a second bore longitudinally therethrough and the union probe section has a second bore longitudinally therethrough aligned with the shaft section second bore, the connector further comprising, a third electric conductor within and extending through the upper portions between the union ends, a shaft section second insert in the shaft section bore with said third electrical conductor therein, a probe section second insert in the probe section bore with said third electrical conductor therein.

11. A probe connector for connecting to and disconnecting from a shaft, comprising, a union formed of electromagnetically insulative material having a shaft section at a union shaft end and a probe section at a union probe end disconnectably joined together, the shaft section including an upper portion with a contact surface and having first and second bores longitudinally therethrough and a lower portion including a contact surface and a lower portion bore, the probe section including an upper portion with a contact surface and having first and second bores longitudinally therethrough aligned with the shaft section first and second bores and a lower portion bore and including a contact surface; the probe section surfaces matching the surfaces of the respective shaft section upper and lower portions, a first electric conductor within and extending through the lower portions between the union ends, a second electric conductor within and extending through the upper portions between the union ends, a third electric conductor within and extending through the upper portions between the union ends, a shaft section first insert in the shaft section bore with said first electrical conductor therein, a shaft section second insert in the shaft section bore with said third electrical conductor therein, a shaft section lower portion insert in the shaft section lower portion bore with said second electrical conductor therein, a probe section first insert in the probe section bore with said second electrical conductor therein, a probe section second insert in the probe section bore with said third electrical conductor therein and a probe section lower portion insert in the probe section lower portion bore with said second electrical conductor therein wherein said shaft section insert and said probe section insert are electrically nonconductive and have magnetic permeabilities less than that of the respective shaft section and probe section such that propagation of electromagnetic waves through the inserts is prevented, the shaft section upper portion extending substantially beyond the shaft section lower portion, and the probe section lower portion extending substantially beyond the probe section upper portion with the upper of the shaft section overlapping the lower portion of the probe section on matching longitudinal ledges to form an integral body, the respective matching probe section and shaft section contact surfaces and longitudinal ledges in close face to face contact with effectively no airspace therebetween therein forming an electromagnet insulator between the electric conductor within the lower portions and the electric conductor within the upper portions, the first and second conductors establishing electrical contact when the sections are joined together.

12. The probe connector of claim 11 in which the union is cylindrical and in which the longitudinal ledges are planar, the lower portion bores and inserts below, and the upper portion bores and inserts above, the planar longitudinal ledges.

13. The probe of connector 12 in which the respective shaft and probe upper portions have two inserts in matching bores and respective shaft and probe lower portions each have one insert in a matching bore.

14. The probe connector of claim 13 further comprising at least one pin extending longitudinally from at least one insert in one of said shaft and probe sections and at least one socket in at least one of the other inserts in the other of said shaft and probe sections aligned to receive the pin.

15. The probe of connector 14 further comprising four pins extending longitudinally from the lower portion of at least one insert in one of shaft or probe sections and four sockets in the lower portion of at least one of the other inserts in the other of the shaft or probe sections aligned to receive the pins.

16. The probe connector of claim 14 comprising three pins extending longitudinally from at least one insert in one of shaft or probe sections and three sockets in at least one of the other inserts in the other of the shaft or probe sections aligned to receive the pins.

17. The probe connector claim 16 comprising three pins extending longitudinally from two inserts in one of shaft or probe sections and three sockets in two of the other inserts in the other of the shaft or probe sections aligned to receive the pins.

18. The combination of an eddy current probe including a drive coil driven by an alternating current that produces an irradiating electromagnetic field and a sense coil in which is induced an electric current from a sensed electromagnetic field, the improvement comprising a probe connector section on a probe end and a shaft comprising a shaft connector section on a shaft end matching and connectable to the probe connector section, wherein the probe connector section includes an upper portion with a contact surface and having first and second bores longitudinally therethrough aligned with the shaft section first and second bores and a lower portion bore and including a contact surface; the probe section surfaces matching the surfaces of the respective shaft section upper and lower portions, a first electric conductor within and extending through the lower portions between the union ends, a second electric conductor within and extending through the upper portions between the union ends, a third electric conductor within and extending through the upper portions between the union ends, and the shaft connector section includes an upper portion with a contact surface and having first and second bores longitudinally therethrough and a lower portion including a contact surface and a lower portion bore, a shaft section first insert in the shaft section bore with said first electrical conductor therein, a shaft section second insert in the shaft section bore with said third electrical conductor therein, a shaft section lower portion insert in the shaft section lower portion bore with said second electrical conductor therein, a probe section first insert in the probe section bore with said second electrical conductor therein, a probe section second insert in the probe section bore with said third electrical conductor therein, a probe section lower portion insert in the probe section lower portion bore with said second electrical conductor therein, wherein said shaft section insert and said probe section insert are electrically nonconductive and have magnetic permeabilities less than that of the respective shaft section and probe section such that propagation of electromagnetic waves through the inserts is prevented, the shaft section upper portion extending substantially beyond the shaft section lower portion, and the probe section lower portion extending substantially beyond the probe section upper portion with the upper portion of the shaft section overlapping the lower portion of the probe section on matching sliding ledges to form an integral body, the first and probe section surfaces and sliding ledges in close face to face contact with effectively no airspace therebetween therein forming an electromagnet insulator between the electric conductor within the lower portions and the electric conductor within the upper portions, the first and second conductors establishing electrical contact when the sections are joined together.

* * * * *